United States Patent [19]

Khan

[11] 4,188,877

[45] Feb. 19, 1980

[54] DRIVE MECHANISM FOR A COMPACTOR

[75] Inventor: Aman U. Khan, Stevensville, Mich.

[73] Assignee: Whirlpool Corporation, Benton Harbor, Mich.

[21] Appl. No.: 922,671

[22] Filed: Jul. 7, 1978

[51] Int. Cl.[2] ..... B30B 1/18

[52] U.S. Cl. ..... 100/290; 100/229 A; 74/424.8 R

[58] Field of Search ..... 100/229 A, 290; 74/424.8 R, 424.8 B, 89.15; 254/98, 103

[56] References Cited

U.S. PATENT DOCUMENTS

| | | | |
|---|---|---|---|
| 3,353,478 | 11/1967 | Hopkins | 100/229 A |
| 3,732,805 | 5/1973 | Moon | 100/289 |
| 3,734,009 | 5/1973 | Engerbretsen | 100/290 |
| 3,772,987 | 11/1973 | Difley | 100/290 |
| 3,839,954 | 10/1974 | Bourgeois | 100/229 A |
| 3,921,515 | 11/1975 | Eckerle | 100/229 A |

FOREIGN PATENT DOCUMENTS

| | | | |
|---|---|---|---|
| 2123435 | 12/1972 | Fed. Rep. of Germany | 100/290 |

*Primary Examiner*—Billy J. Wilhite

*Attorney, Agent, or Firm*—Wegner, Stellman, McCord, Wiles & Wood

[57] ABSTRACT

An improved structure for movably mounting a ram to a support in a refuse compactor. The mounting structure includes a plurality of threaded force transfer elements fixed to the ram and connecting structure fixedly associated with the driven sprocket of the motor drive. The connecting devices are threadedly associated one each with the force transfer elements and are mounted to the support structure of the compactor in such a manner as to dispose the driven sprockets in accurate spaced center-to-center relationship corresponding accurately to the center-to-center relationship of the force transfer elements as carried by the ram. A structural arrangement provides a binding-free drive of the force transfer elements by the drive mechanism of the compactor.

12 Claims, 5 Drawing Figures

FIG. 1
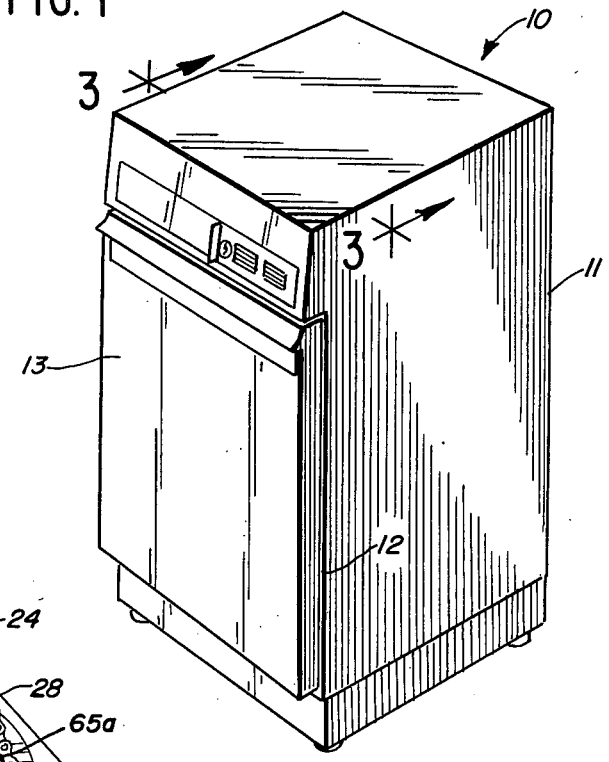
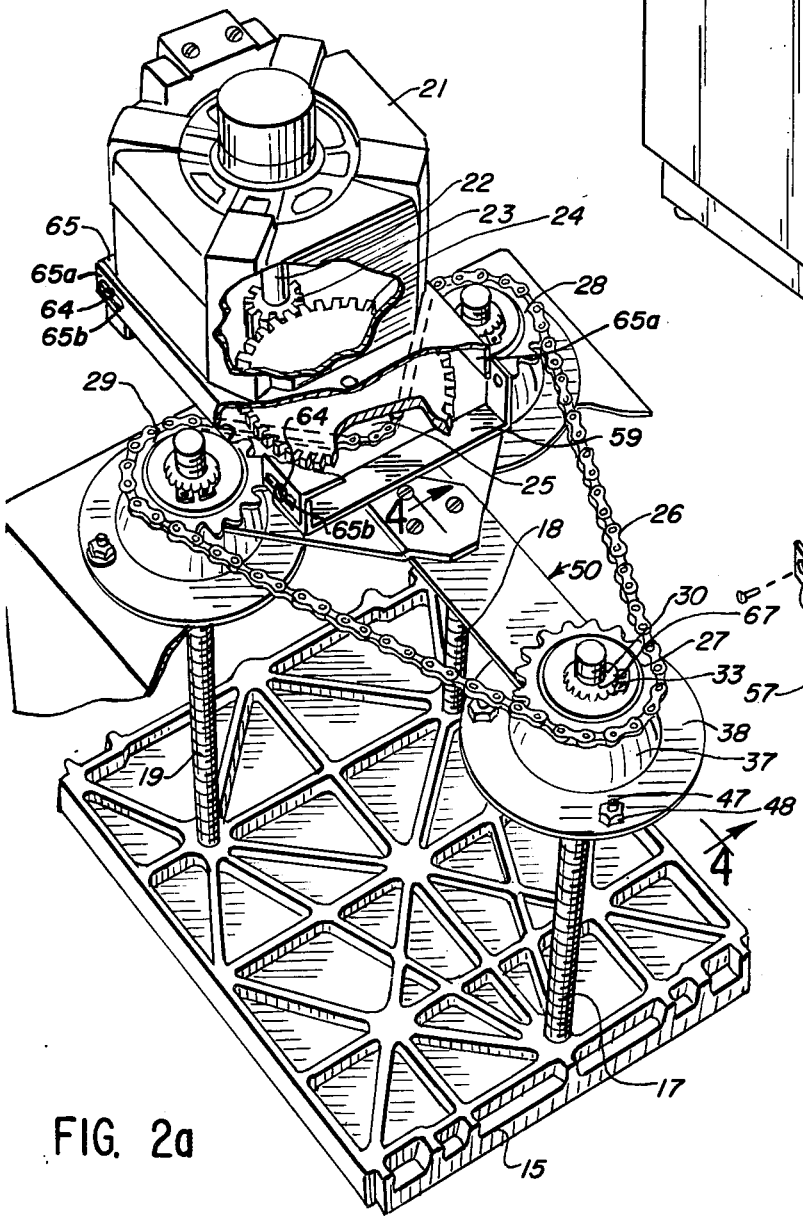
FIG. 2a
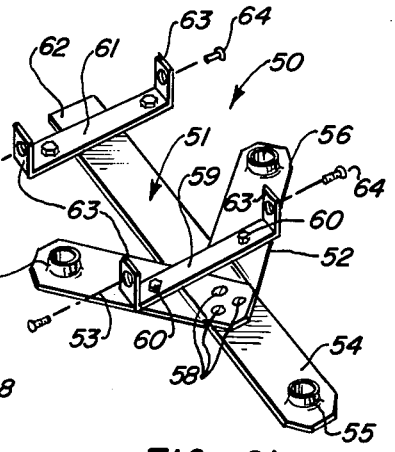
FIG. 2b

DRIVE MECHANISM FOR A COMPACTOR

BACKGROUND OF THE INVENTION

1. Field of the Invention

This invention relates to refuse compactors and, in particular, to means for providing binding-free movement of the ram in effecting compaction of refuse and the like therein.

2. Description of the Prior Art

In U.S. Pat. No. 3,353,478, of Stephen Hopkins, a waste collecting and compacting unit is shown wherein a press frame is mounted to the ram so as to move the ram as a result of rotation of a plurality of worm shafts threaded to the press frame. The lower end of each worm shaft is provided with a driven sprocket and the upper end of each worm shaft is rotatably carried by a bearing mounted directly in the frame support structure of the compactor unit. An idler is provided for taking slack out of the drive chain in an effort to secure synchronism of the driven sprockets.

Jerry W. Moon, in U.S. Pat. No. 3,732,805, shows a refuse compactor utilizing a jack screw and a toggle linkage. The screw and motor drive train are carried as a unit by the toggle linkage and move bodily therewith in the operation of the compactor.

In U.S. Pat. No. 3,772,987 of Charles R. Difley et al, which patent is owned by the assignee hereof, a refuse compactor is shown having a mounting member removably secured to a base wall portion of the compactor cabinet and arranged to carry the drive means. The mounting member is adjustably positionable on the base wall for adjusting the tension in the chain drive portion of the power takeoff of the drive means.

In U.S. Pat. No. 3,839,954, of Joseph F. Bourgeois, a trash container mounting for a trash compactor is shown utilizing a single drive screw for the ram disposed centrally of the ram assembly and parallel to a plurality of side channels controlling the stroke of the ram.

William A. Eckerle et al, in U.S. Pat. No. 3,921,515, show a compactor having a jack screw pressure-applying mechanism with the linkage mechanism thereof being arranged to maintain a pressure plate portion of the structure generally horizontal in the compacting operation.

SUMMARY OF THE INVENTION

The present invention comprehends an improved refuse compactor structure wherein a ram is movably mounted to a support to effect desirable forcible compaction of refuse in the compactor. The structure includes drive means having a drive motor and drive chain driven by the drive motor, a plurality of driven sprockets, a corresponding plurality of parallel threaded force transfer elements fixed to the ram, a corrresponding plurality of connecting means fixedly associated one each with the driven sprockets and threadedly associated one each with the force transfer elements, and mounting means for mounting the connecting means to the support means to dispose the driven sprockets in spaced center-to-center relationship corresponding accurately to the center-to-center relationship of the force transfer elements and in driven relationship with the drive chain to provide a binding-free drive of the force transfer elements by the drive means.

The drive means may include a driver sprocket driven by the motor for driving the drive chain. The mounting means may include means for accurately adjusting the center-to-center relationship between the driver sprocket and the driven sprockets associated one each with the threaded force transfer elements of the compacting mechanism.

The mounting means may include a yoke engaging each of the connecting means. In the illustrated embodiment, the yoke comprises a trifurcated member and may be provided with adjustable connecting means for adjustably mounting the drive motor thereto.

The mounting means may include bearing means carried by the connecting means and cooperating bearing means carried by the support means. In the illustrated embodiment, the bearing means may comprise segmentally spherical bearing means providing selfadjustment thereof in the compacting operation.

The mounting means for mounting the connecting means to the support means may include spacer means for accurately maintaining the driven sprockets in spaced center-to-center relationship corresponding to the center-to-center relationship of the force transfer elements and in driven relationship with the drive chain.

The spacer means may include collar portions embracing the connecting means and a yoke portion accurately positioning the collar portions. The yoke portions may be removably secured to the collar portions.

Thus, the refuse compactor structure of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a perspective view of a refuse compactor having improved ram mounting and operating means embodying the invention;

FIG. 2*a* is a fragmentary perspective view illustrating the structure of the ram mounting and operating means;

FIG. 2*b* is a fragmentary exploded perspective view of the mounting means for mounting the operating means to the support means of the compactor structure;

DESCRIPTION OF THE PREFERRED EMBODIMENT

Figure 3:
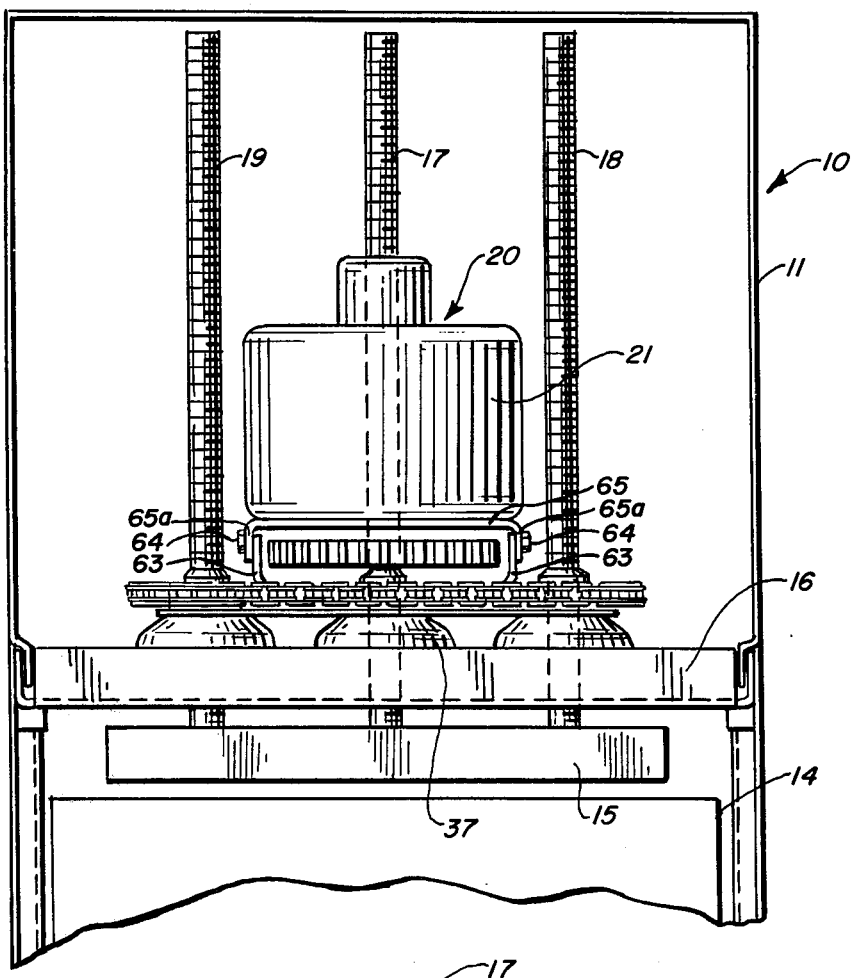
FIG. 3 is a fragmentary vertical section of the compactor taken substantially along the line 3—3 of FIG. 1.

In the exemplary embodiment of the invention as disclosed in the drawing, a refuse compactor generally designated 10 is provided for compacting refuse and the like such as in domestic applications. In the illustrated embodiment, the compactor includes an outer cabinet 11, defining a front opening 12 which is selectively closed by a front door 13 carried by a receptacle in the form of a drawer 14. The drawer 14 is suitably movably mounted in the cabinet to be selectively disposed within the cabinet subjacent a compacting ram 15. The ram is mounted to be forcibly urged downwardly into the receptacle or drawer 14 to effect the desired compaction of refuse previously placed in the receptacle and the present invention is concerned with an improved means for effecting the desired mounting and forceful compaction movement of the ram in the compactor 10.

More specifically, the compactor includes a horizontal support member 16 which overlies the receptacle 14 when the receptacle is in the inner compaction position, as seen in FIG. 3. The ram is carried on the lower end of the three threaded force transfer elements 17, 18 and 19, which, as seen in FIGS. *2a* and 3, extend vertically upwardly from the ram.

The ram is moved vertically down into the receptacle 14 in the power stroke and upwardly from the receptacle in the retracting stroke by means of a drive means generally designated 20 which includes an electrical drive motor 21 having an output shaft 22 provided with a pinion 23 driving a gear 24 coaxially carrying a sprocket 25. A drive chain 26 engages the sprocket 25 which thusly acts as a driver sprocket. The chain is entrained over three driven sprockets 27, 28 and 29 associated respectively with the three force transfer elements 17, 18 and 19.

Figure 4:
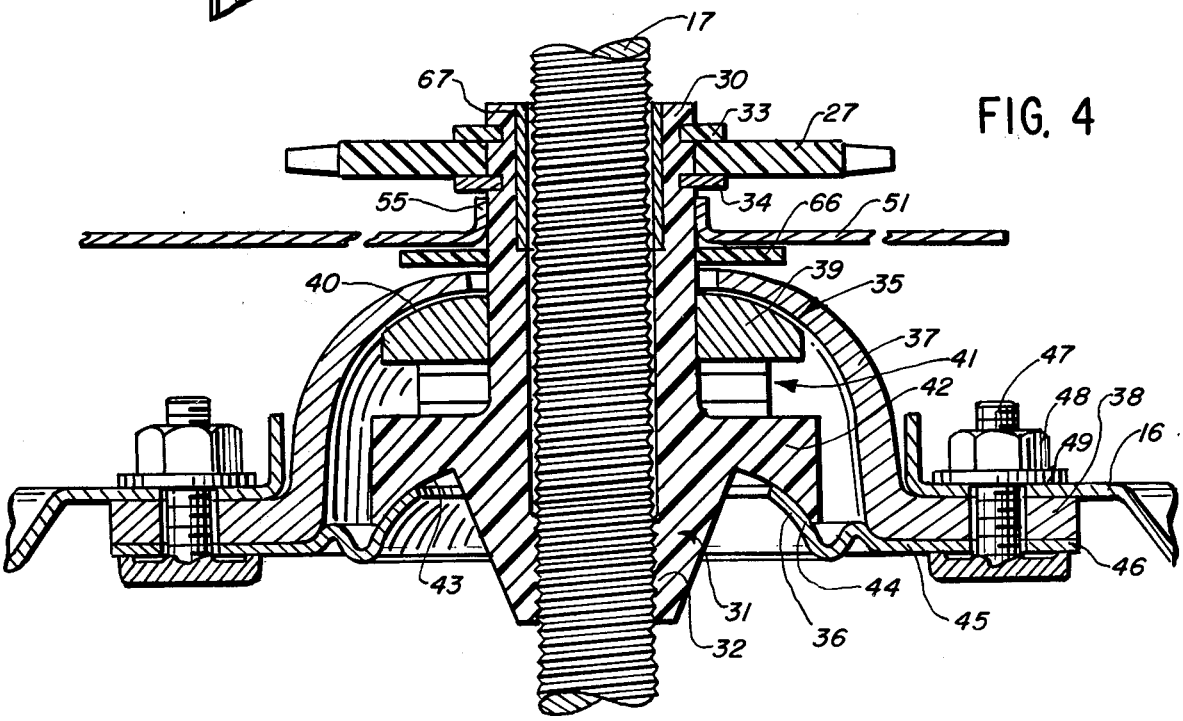
FIG. 4 is a fragmentary enlarged vertical section of a portion of the drive structure.

More specifically as shown in FIG. 4 wherein the drive structure is associated with force transfer element 17 as illustrated (it being understood that the structures associated with each of the other force transfer elements 18 and 19 are similar), the driven sprocket 27 is fixedly secured to the upper end 30 of a power nut 31 comprising a connecting element having a threaded portion 32 threadedly engaging the force transfer element 17. The sprocket 27 may be retained on the upper end 30 of the connecting means nut between a pair of retaining rings 33 and 34. A suitable bearing 67 may be provided in the form of a sleeve between the upper portion 30 of the nut 31 and the threaded transfer element 17, as shown in FIG. 4.

Power nut 31 is adjustably mounted to the compactor support 16 by a pair of self-aligning bearings 35 and 36. Bearing 35 includes a segmentally spherical housing element 37 having a flange portion 38. Bearing 35 further includes a bearing block 39 having a segmentally spherical surface 40 slidably engaging the segmentally spherical bearing portion 37 and being carried on the power nut 31 by means of a needle bearing generally designated 41. The needle bearing seats on a collar portion 42 of the power nut, the underside of which defines a segmentally spherical bearing surface 43 slidably engaging a complementary bearing portion 44 of a retainer element 45 having an outer flange portion 46. Flange 38 and flange 46 are clamped to the support portion 16 by suitable clamping bolts 47 and nuts 48. In the illustrated embodiment, three such clamping structures are provided at 120°-spaced relationship about the axis of the elements 37 and 45. A suitable locking washer 49 may be associated with each nut and bolt for locking the assembly to the support.

As shown in FIG. *2b*, a yoke assembly generally designated 50 is provided for maintaining a high accuracy of the disposition of the power nut 31 relative to the threaded force transfer elements 17, 18 and 19. The yoke assembly 50 includes a base element 51 and a pair of diverging nut mounting arms 52 and 53. One end 54 of the base element is provided with an annular boss 55 accurately fitting the upper portion 30 of the power nut 31 associated with force transfer element 17. Arm 52 is provided with a corresponding upstanding annular boss 56 for fitted association with the power nut 31 associated with force transfer element 18 and arm 53 is provided with a similar upstanding annular boss 57 for fitted association with power nut 31 associated with force transfer element 19.

Arms 52 and 53 are retained in accurate angular relationship to the base 51 by means of three screws 58. Additionally, a motor mounting bracket 59 is secured at its opposite ends by means of screws 60 to the arms 52 and 53 to provide additional fixed association of the arms relative to base 51. A similar motor mounting element 61 is provided at the distal end 62 of the base 51. Each of the elements 59 and 61 is provided with upstanding end flanges 63. Screws 64 and horizontal slots 65(*b*) are provided for adjustably securing the end flanges 63 to a motor base 65 carrying the drive motor 21, as seen in FIGS. *2a* and 3.

The motor base 65 is provided with downturned side flanges 65(*a*) having four horizontal slots 65(*b*) for motor position adjustment through which pass the screws 64. The present invention thus provides means for accurately adjusting the center-to-center relationship between the driver sprocket and the driven sprocket by moving the motor base 65 to the desired position relative to the mounting element end flanges 63 and the tightening means 64 at the adjusted position of the motor.

To insulate noise in the device, a plastic washer 66 may be provided between the yoke assembly 50 and upper portion of the bearing housing 37, as shown in FIG. 4.

Thus, each of the force transfer elements 17, 18 and 19, which, as shown, may comprise elongated threaded rods, is engaged by a corresponding power nut 31 which is maintained in accurate, axial relationship with its associated force transfer element and in accurate spaced relationship to each of the other power nuts by means of the yoke assembly structure 50 and the cooperating self-aligning bearings 35 and 36 to provide facilitated assembly and a binding-free operation of the compactor in normal use.

In the illustrated embodiment, the sprockets are splined to the upper end of the power nuts to effect a rotation thereof as a result of the operation of the drive motor 21 which is transmitted to the driven sprockets 27, 28 and 29 concurrently by the chain 26. The sprockets are maintained in accurate spaced center-to-center relationship by the yoke assembly 50 so as to, in turn, maintain the power nuts 31 in accurate spaced center-to-center relationship in accurate accordance with the spaced relationship of the force transfer elements 17, 18 and 19, thereby to provide a nonbinding operation of the ram.

The individual power nuts are maintained in accurate coaxial aligned association with the associated force transfer element by the cooperative self-aligning, segmentally spherical bearings 35 and 36 to further assure nonbinding operation of the ram in normal use of the compactor. Needle bearing 41 assures a free rotative movement of the power nut relative to the force transfer element.

In summary, the improved mounting means comprises a plurality of self-aligning bearings mounted to a supporting portion of the refuse compactor and a yoke means for positioning the power nuts in accurate center-to-center spaced relationship relative to the force transfer elements carried by the ram. The maintained spaced relationship of the power nuts further serves to maintain accurate center-to-center spaced relationship of the driven sprockets which are also carried on the power nuts so as to provide a maintenance-free sprocket arrangement in transferring power from the drive motor to the ram. The yoke means for providing the improved maintained accurate spaced relationship of the drive nuts is extremely simple and economical of construction while yet providing the improved, positive center-to-center spacing in turn providing the desired binding-free operation of the apparatus.

The foregoing disclosure of specific embodiments is illustrative of the broad inventive concepts comprehended by the invention.

The embodiments of the invention in which an exclusive property or privilege is claimed are defined as follows:

1. In a refuse compactor including support means and a ram, an improved means for movably mounting the ram to the support means for forcible compaction of refuse in the compactor, comprising:

drive means including a drive motor, a driver sprocket driven by said drive motor, and a drive chain driven by said driver sprocket;

a plurality of driven sprockets;

a corresponding plurality of parallel threaded force transfer elements fixed to the ram;

a corresponding plurality of connecting means fixedly associated one each with said driven sprockets and threadedly associated one each with said force transfer elements; and mounting means for mounting said connecting means to said support means to dispose said driven sprockets in spaced center-to-center relationship corresponding accurately to the center-to-center relationship of said force transfer elements and in driven relationship with said drive chain to provide a binding-free drive of said force transfer elements by said drive means, said mounting means including means for accurately adjusting the center-to-center relationship between said driver sprocket and said driven sprockets.

2. The refuse compactor structure of claim 1 wherein said mounting means includes a yoke engaging each of said connecting means.

3. The refuse compactor structure of claim 1 wherein said plurality of driven sprockets comprises three driven sprockets and said mounting means defines a trifurcated yoke engaging each of said connecting means.

4. The refuse compactor structure of claim 1 wherein said mounting means includes bearing means carried by said connecting means and cooperating bearing means carried by said support means.

5. In a refuse compactor including support means and a ram, an improved means for movably mounting the ram to the support means for forcible compaction of refuse in the compactor, comprising:

drive means including a drive motor and drive chain driven by said drive motor;

a plurality of driven sprockets;

a corresponding plurality of parallel threaded force transfer elements fixed to the ram;

a corresponding plurality of connecting means fixedly associated one each with said driven sprockets and threadedly associated one each with said force transfer elements; and mounting means for mounting said connecting means to said support means to dispose said driven sprockets in spaced center-to-center relationship corresponding accurately to the center-to-center relationship of said force transfer elements and in driven relationship with said driven chain to provide a binding-free drive of said force transfer elements by said drive means, said mounting means including a yoke engaging each of said connecting means and having adjustable connecting means mounting said drive motor thereto.

6. In a refuse compactor including support means and a ram, an improved means for movably mounting the ram to the support means for forcible compaction of refuse in the compactor, comprising:

drive means including a drive motor and drive chain driven by said drive motor;

a plurality of driven sprockets;

a corresponding plurality of parallel threaded force transfer elements fixed to the ram;

a corresponding plurality of connecting means fixedly associated one each with said driven sprockets and threadedly associated one each with said force transfer elements; and mounting means for mounting said connecting means to said support means to dispose said driven sprockets in spaced center-to-center relationship corresponding accurately to the center-to-center relationship of said force transfer elements and in driven relationship with said drive chain to provide a binding-free drive of said force transfer elements by said drive means, said mounting means including segmentally spherical bearing means carried by said connecting means and cooperating segmentally spherical bearing means carried by said support means.

7. In a refuse compactor including support means and a ram, an improved means for movably mounting the ram to the support means for forcible compactor of refuse in the compactor comprising:

drive means including a drive motor and drive chain driven by said drive motor;

a plurality of driven sprockets;

a corresponding plurality of parallel threaded force transfer elements fixed to the ram;

a corresponding plurality of connecting means fixedly associated one each with said driven sprockets and threadedly associated one each with said force transfer elements; and mounting means for mounting said connecting means to said support means to dispose said driven sprockets in spaced center-to-center relationship corresponding accurately to the center-to-center relationship of said force transfer elements and in driven relationship with said drive chain to provide a binding-free drive of said force transfer elements by said drive means, said mounting means including self-aligning bearings mounted to said support means.

8. The refuse compactor structure of claim 7 wherein said selfaligning bearings include a portion formed integral with said connecting means.

9. The refuse compactor structure of claim 7 wherein said selfaligning bearings are spaced on said support means, and said connecting means is provided with complementary bearing means retained between and cooperating with said spaced bearings to provide a self-aligning mounting of the connecting means to the support means.

10. The refuse compactor structure of claim 7 wherein said spacer means engages said connecting means adjacent said bearings.

11. In a refuse compactor including support means and a ram, improved means for movably mounting the ram to the support means for forcible compaction of refuse in the compactor, comprising:

drive means including a drive motor and drive chain driven by said drive motor;

a plurality of driven sprockets;

a corresponding plurality of projecting parallel threaded force transfer elements fixed to the ram;

a corresponding plurality of connecting means fixedly associated one each with said driven sprockets and threadedly associated one each with said force transfer elements; and mounting means for mounting said connecting means to said support means and including spacer means having collar portions embracing said connecting means and a yoke portion accurately positioning said collar portions for accurately maintaining said driven sprockets in spaced center-to-center relationship corresponding to the center-to-center relationship of said force transfer elements and in driven relationship with said drive chain to provide a binding-free drive of said force transfer elements of said drive means.

12. In a refuse compactor including support means and a ram, improved means for movably mounting the ram to the support means for forcible compaction of refuse in the compactor, comprising:

drive means including a drive motor and drive chain driven by said drive motor;

a plurality of driven sprockets;

a corresponding plurality of projecting parallel threaded force transfer elements fixed to the ram;

a corresponding plurality of connecting means fixedly associated one each with said driven sprockets and threadedly associated one each with said force transfer elements; and mounting means for mounting said connecting means to said support means and including spacer means having collar portions embracing said connecting means and a yoke portion, and means for removably securing said yoke portion to said collar portions to accurately fixedly space said collar portions for accurately positioning said collar portions and thereby accurately maintaining said driven sprockets in spaced center-to-center relationship corresponding to the center-to-center relationship of said force transfer elements and in driven relationship with said drive chain to provide a binding-free drive of said force transfer elements of said drive means.

* * * * *